US009933262B2

(12) United States Patent
Vogel

(10) Patent No.: US 9,933,262 B2
(45) Date of Patent: Apr. 3, 2018

(54) POSITIONING SYSTEM HAVING A MASTER-SLAVE CONFIGURATION

(71) Applicant: Caterpillar Inc., Peoria, IL (US)

(72) Inventor: Nicholas Robert Vogel, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 220 days.

(21) Appl. No.: 14/809,943

(22) Filed: Jul. 27, 2015

(65) Prior Publication Data

US 2017/0030718 A1 Feb. 2, 2017

(51) Int. Cl.

| | |
|---|---|
| ***G01C 21/00*** | (2006.01) |
| ***G01C 21/16*** | (2006.01) |
| *E02F 9/26* | (2006.01) |

(52) U.S. Cl.

CPC ..... *G01C 21/165* (2013.01); *E02F 9/261* (2013.01)

(58) Field of Classification Search

None

See application file for complete search history.

(56) References Cited

U.S. PATENT DOCUMENTS

| | | | | |
|---|---|---|---|---|
| 5,275,565 | A * | 1/1994 | Moncrief | A63F 13/08 345/1.3 |
| 6,282,496 | B1 | 8/2001 | Chowdhary | |
| 7,103,477 | B1 | 9/2006 | Lee | |
| 8,457,891 | B1 | 6/2013 | Vallot et al. | |
| 8,761,439 | B1 * | 6/2014 | Kumar | G06T 7/73 382/103 |
| 8,768,621 | B2 | 7/2014 | Ruizenaar | |
| 9,205,828 | B1 * | 12/2015 | Lombrozo | B60W 30/00 |
| 2008/0109141 | A1 | 5/2008 | Nichols et al. | |
| 2013/0297204 | A1 | 11/2013 | Bartels | |
| 2014/0121960 | A1 | 5/2014 | Park | |
| 2014/0180579 | A1 * | 6/2014 | Friend | G01B 11/00 701/469 |

* cited by examiner

*Primary Examiner* — Todd Melton

*Assistant Examiner* — Jason R Roberson

(74) *Attorney, Agent, or Firm* — Finnegan, Henderson, Farabow, Garrett & Dunner, LLP; James S. Bennin

(57) ABSTRACT

A positioning system for generating pose information of a machine includes a primary positioning controller and a plurality of local positioning controllers coupled to the primary positioning controller. The primary positioning controller is configured to generate primary pose information of the machine. The primary pose information reflects an overall pose of the machine. Each of the local positioning controllers is configured to generate local pose information based on at least the primary pose information. The local pose information reflects a local pose of a portion of the machine corresponding to the local positioning controller.

20 Claims, 4 Drawing Sheets

POSITIONING SYSTEM HAVING A MASTER-SLAVE CONFIGURATION

TECHNICAL FIELD

The present disclosure relates to a positioning system and, more particularly, to a positioning system having a master-slave configuration.

BACKGROUND

Excavation machines such as backhoe loaders, haul trucks, wheel loaders, scrapers, and other types of heavy equipment, are used to perform a variety of tasks. Some of these tasks involve carrying large, awkward, loose, and/or heavy loads along rough and crowded roadways. And because of the size of the machines and/or poor visibility provided to operators of the machines, these tasks can be difficult to complete effectively. For this reason, some machines are equipped with perception systems that provide views of a machine's environment to the operator.

Conventional perception systems include one or more perception sensors, such as LIDAR (light detection and ranging) devices, that capture different images, which are then combined to form a surround view. To combine the images, poses of the perception sensors need to be determined. For this purpose, a rate sensing device can be used to provide pose information at the location of each perception sensor. The pose information may include for example, one or more of position, orientation, linear velocity, angular velocity, and acceleration. The rate sensing device may include one or more rate sensors and may be, for example, an inertial measurement unit (IMU) or a visual odometry device. Such a perception system could measure and compensate for, e.g., vibration or movement of the perception sensors, to provide better results for the perception.

The rate sensing devices, however, are not ideal, and may have noises, bias, or drifts due to, for example, aging and temperature. The noises, bias, and drifts of the rate sensing devices may accumulate, affecting the accuracy of the determined pose of the perception sensors. In conventional technology, a state update source is used to update the readings of the rate sensing devices. The state update source can be a global navigation satellite system (GNSS), such as a global positioning system (GPS). The state update source can also be another system that is capable of providing state update, such as a pseudolite system, a perception based positioning system, a ranging radio system, a speedometer, an inclinometer, or an accelerometer. Such a configuration is not only used in perception systems, but may also be used in other systems using rate sensing devices, such as IMUs.

U.S. Pat. No. 8,457,891 of Vallot et al., which issued on Jun. 4, 2013 (the '891 patent), discloses a navigation system using an IMU for navigating a vehicle and a GPS to correct accumulating errors from the IMU. However, in such a conventional perception system, when GPS signal is not available, the readings of the IMUs cannot be updated. In this scenario, local disturbances may affect the result of the perception.

The disclosed system is directed to overcoming one or more of the problems set forth above and/or other problems of the prior art.

SUMMARY

In one aspect, the present disclosure is directed to a positioning system for generating pose information of a machine. The positioning system includes a primary positioning controller and a plurality of local positioning controllers coupled to the primary positioning controller. The primary positioning controller is configured to generate primary pose information of the machine. The primary pose information reflects an overall pose of the machine. Each of the local positioning controllers is configured to generate local pose information based on at least the primary pose information. The local pose information reflects a local pose of a portion of the machine corresponding to the local positioning controller.

In another aspect, the present disclosure is directed to a method for generating pose information of a machine. The method includes generating primary pose information of the machine and generating local pose information based on at least the primary pose information. The primary pose information reflects an overall pose of the machine. The local pose information reflects a local pose of a portion of the machine.

In yet another aspect, the present disclosure is directed to a perception system for providing a surround view of a machine. The perception system includes a plurality of perception sensors and a positioning system coupled to the perception sensors. The positioning system includes a primary positioning controller and a plurality of local positioning controllers. The primary positioning controller is configured to generate primary pose information of the machine. The primary pose information reflects an overall pose of the machine. Each of the local positioning controllers is coupled to the primary positioning controller and one of the perception sensors, and is configured to generate local pose information based on at least the primary pose information. The local pose information reflects a local pose of the corresponding perception sensor.

DETAILED DESCRIPTION

Figure 1A:
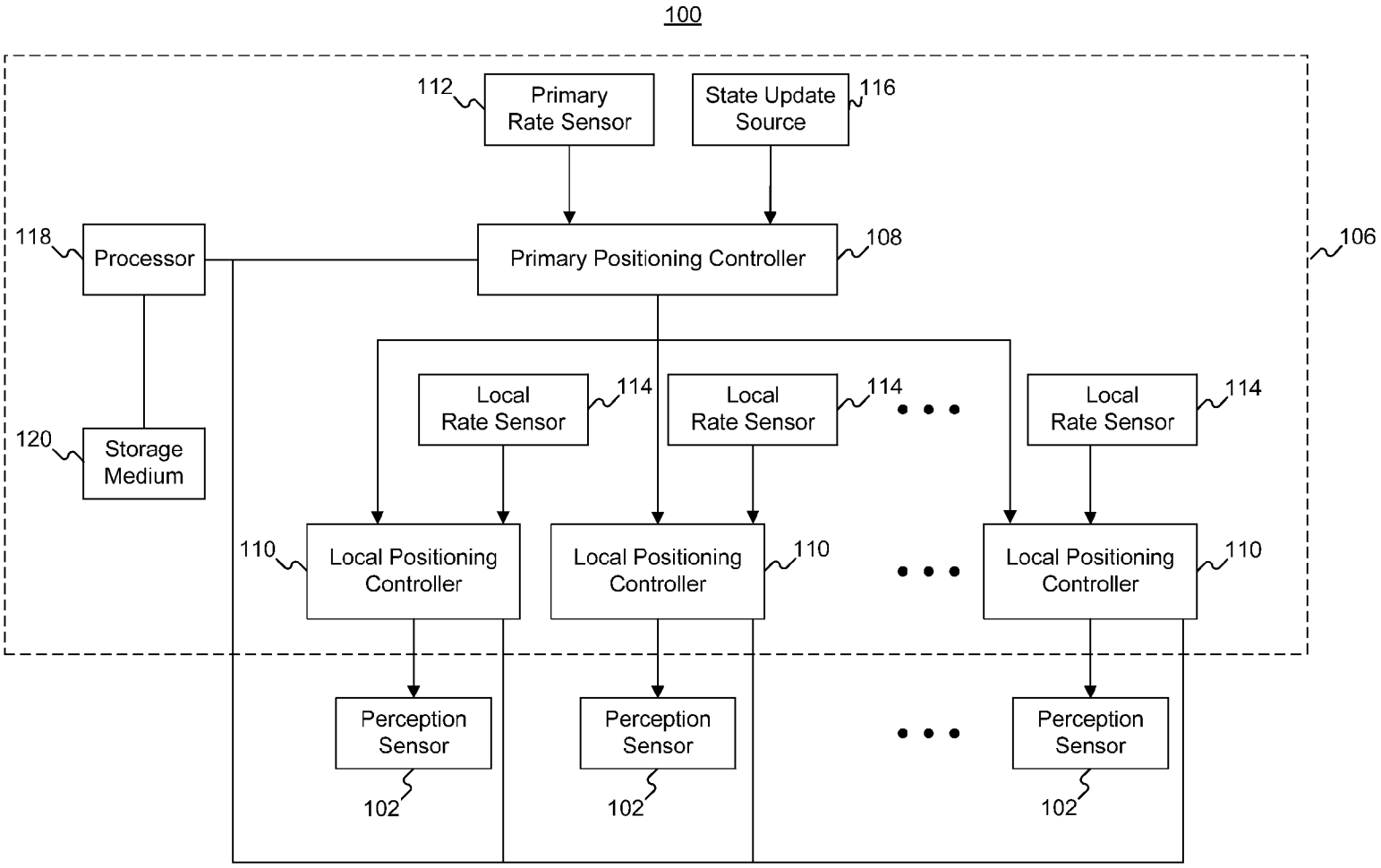
FIG. 1A is a diagrammatic illustration of an exemplary disclosed perception system including an exemplary disclosed positioning system.
Figure 1B:
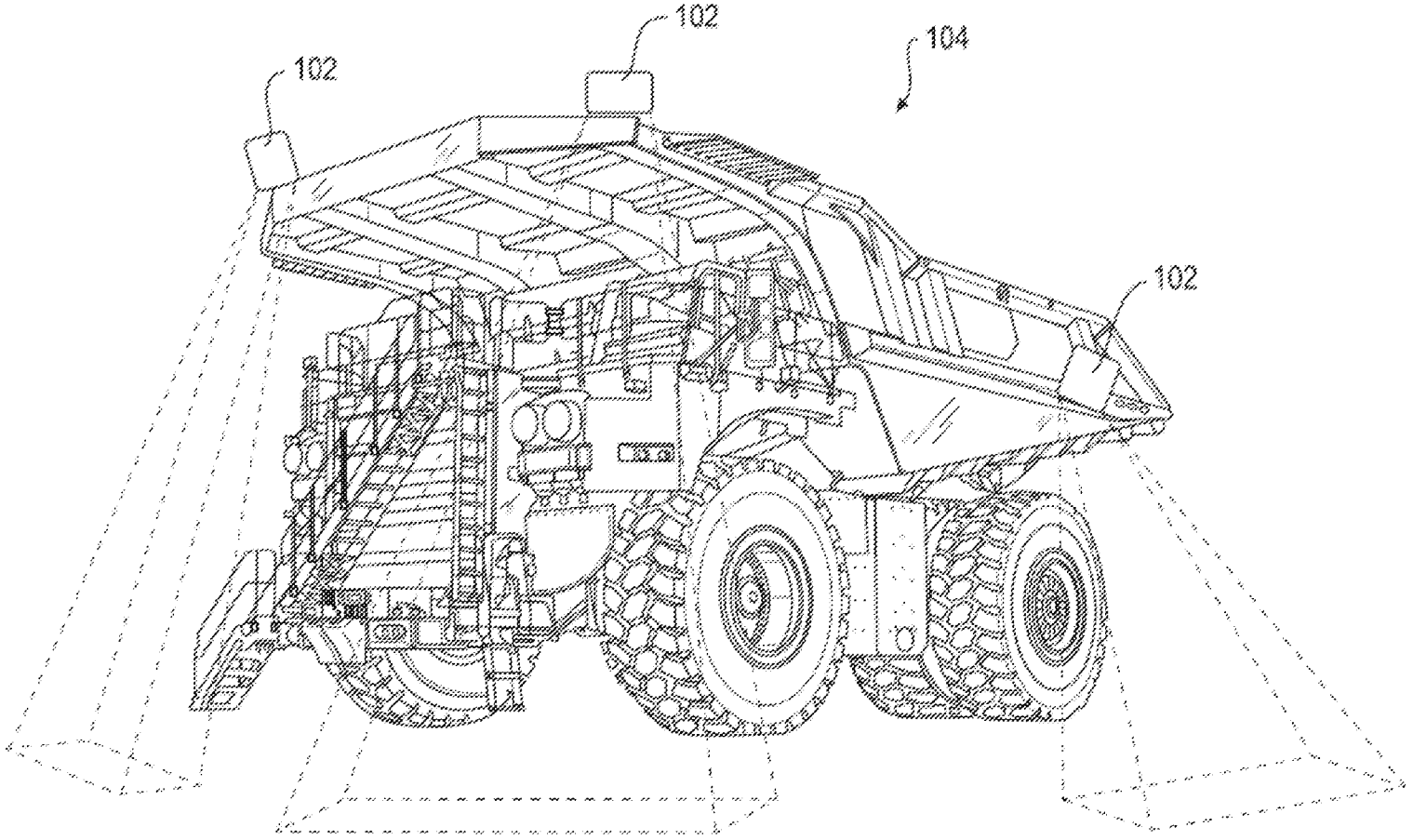
FIG. 1B is a pictorial illustration of an exemplary disclosed machine having the perception system of FIG. 1 mounted thereon.

FIG. 1A illustrates an exemplary perception system 100 consistent with embodiments of the present disclosure. Perception system 100 includes a plurality of perception sensors 102, which, as shown in FIG. 1B, can be mounted on outside surfaces of a machine 104 to provide a surround view of machine 104. Perception sensors 102 may include devices that are capable of providing scene data describing an environment in the vicinity of machine 104, such as detecting and ranging objects located around machine 104. For example, each perception sensor 102 may be embodied by a LIDAR (light detection and ranging) device, a RADAR (radio detection and ranging) device, a SONAR (sound navigation and ranging) device, a camera device, or another device known in the art, in one example, each perception sensor 102 may include an emitter that emits a detection beam, and an associated receiver that receives a reflection of that detection beam. Based on characteristics of the reflected beam, a distance and a direction from an actual sensing location of perception sensor 102 on machine 104 to a portion of a sensed physical object may be determined. By utilizing beams in a plurality of directions, perception sensors 102 may generate a picture of the surroundings of machine 104. For example, if perception sensors 102 are embodied by LIDAR devices or other devices using multiple laser beams, perception sensors 102 may generate a cloud of points as the scene data describing an environment in the vicinity of machine 104.

According to the present disclosure, images acquired by perception sensors 102 are stitched together to thrill the surround view. To ensure the acquired images are properly stitched, local pose information, such as position orientation and velocity, of perception sensors 102 are needed.

Referring again to FIG. 1A, perception system 100 further includes a positioning system 106 consistent with embodiments of the present disclosure. Positioning system 106 has a "master-slave" configuration and includes a primary positioning controller (also referred to as a "master positioning controller") 108 and a plurality of local positioning controllers (also referred to as "slave positioning controllers") 106. The primary positioning controller 108 may implement a primary Kalman filter (also referred to as a "master Kalman filter") to provide overall pose information of machine 104. The overall pose information is also referred to as primary or master pose information, which includes, for example, the velocity and orientation of machine 104. As shown in FIG. 1A, each perception sensor 102 is coupled to one of the plurality of local positioning controllers 110. Each local positioning controller 110 may implement a local Kalman filter (also referred to as a "slave Kalman filter") to provide the local pose information to its corresponding perception sensor 102. The local pose information includes, for example, the velocity and orientation of corresponding perception sensor 102. Details of primary positioning controller 108 and local positioning controllers 110 are described below.

As shown in FIG. 1A, positioning system 106 also includes a primary rate sensing device 112 and a plurality of local rate sensing devices 114. Each of primary rate sensing device 112 and local rate sensing devices 114 is configured to provide pose information, such as a rate of change of a position-related parameter, including, for example, linear velocity, angular velocity, or acceleration. Each of primary rate sensing device 112 and local rate sensing devices 114 may include one or more rate sensors and may be, for example, an inertial measurement unit (IMU) or a visual odometry device. Specifically, primary rate sensing device 112 may include devices that provide, for example, angular rates and acceleration of machine 104. Similarly, each local rate sensing device 114 may include devices that provide, for example, angular rates and acceleration of a corresponding perception sensor 102. For example, each of primary rate sensing device 112 and local rate sensing devices 114 may include a 6-degree of freedom (6 DOF) IMU. A 6 DOF IMU includes a 3-axis accelerometer, 3-axis angular rate gyros, and sometimes a 2-axis inclinometer. The 3-axis angular rate gyros may provide signals indicative of the pitch rate, yaw rate, and roll rate of machine 104 or corresponding perception sensor 102. The 3-axis accelerometer may provide signals indicative of the acceleration of machine 104 or corresponding perception sensor 102 in the x, y, and z directions.

According to the present disclosure, primary positioning controller 108 is coupled to primary rate sensing device 112, and receives primary pose incremental information, such as the angular rates and/or acceleration of machine 104, from primary rate sensing device 112. In some embodiments, primary positioning controller 108 may also receive other machine wide measurement inputs, such as position and/or velocity information provided by one or more state update sources 116 and other applicable state information of machine 104. A state update source 116 may be, for example, a GNSS receiver, a pseudolite system, a perception based positioning system, a ranging radio system, a speedometer, or an inclinometer. Similarly, each local positioning controller 110 is coupled to one of local rate sensing devices 114, and receives local pose incremental information, such as the angular rates and/or acceleration, of corresponding perception sensor 102, from the corresponding local rate sensing device 114.

As described above, each of primary positioning controller 108 and local positioning controllers 106 may implement a Kalman filter. The Kalman filter can determine accurate values of measurements observed over time, such as measurements taken in a time series. The Kalman filter's general operation involves two phases, i.e., a propagation or "predict" phase and a measurement or "update" phase. In the predict phase, the value estimate from the previous timestep in the time series is used to generate an a priori value estimate. In the update phase, the a priori estimate calculated in the predict phase is combined with an estimate of the accuracy of the a priori estimate (e.g., the variance or the uncertainty), and a current measurement value to produce a refined, i.e., updated, a posteriori estimate.

Figure 2A:
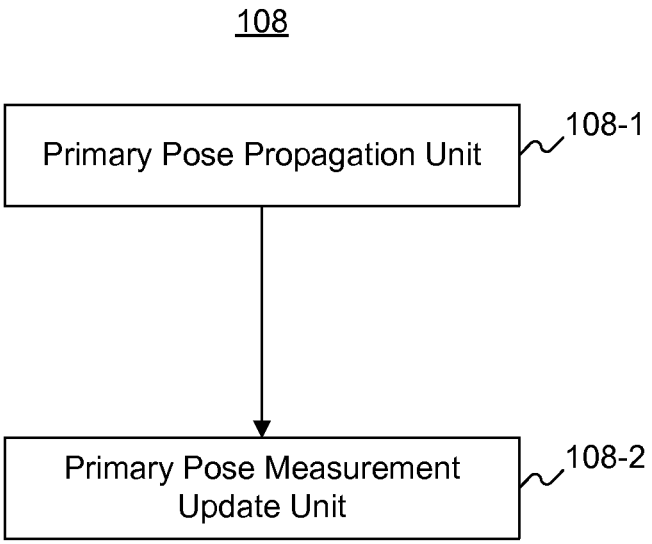
FIG. 2A is a diagrammatic illustration of an exemplary primary positioning controller in the positioning system of FIG. 1A.

FIG. 2A illustrates an exemplary embodiment of primary positioning controller 108. Primary positioning controller 108 includes a primary pose propagation unit 108-1 and a primary pose measurement update unit 108-2. Primary pose propagation unit 108-1 may implement the "predict" phase of the primary Kalman filter. Specifically, primary pose propagation unit 108-1 receives signals (primary pose incremental information) from primary rate sensing device 112. Primary pose propagation unit 108-1 may also receive other signals (other machine wide measurement inputs) reflecting additional machine-wide state information of machine 104. By utilizing these signals, primary pose propagation unit 108-1 may propagate or "predict" certain states of machine 104, such as position, linear velocity, angular velocities, and angular orientation (attitude) of machine 104. Primary pose propagation unit 108-1 outputs a propagated primary pose estimate of one or more of above states of machine 104 to primary pose measurement update unit 108-2.

Primary pose measurement update unit 108-2 may implement the measurement update (or "update") phase of the primary Kalman filter. In the measurement update phase, an updated primary pose estimate is determined for machine 104 by updating the propagated primary pose estimate using, e.g., state update information provided by one or more state update sources 116. In the scenario where the state update information from state update sources 116 are not available, for example, if state update sources 116 are GNSS receivers and lose the connection with GNSS satellites, primary pose measurement update unit 108-2 may update the propagated primary pose estimate using, for example, previously received state update information. The updated primary pose estimate generated by primary pose measurement update unit 108-2 is output as the primary pose information to local positioning controllers 110.

Figure 2B:
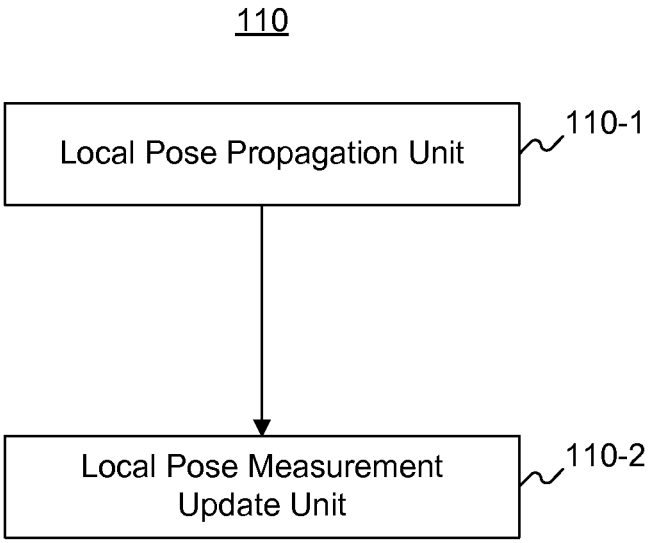
FIG. 2B is a diagrammatic illustration of an exemplary local positioning controller in the positioning system of FIG. 1A.

FIG. 2B illustrates an exemplary embodiment of local positioning controller 110. Local positioning controller 110 includes a local pose propagation unit 110-1 and a local pose measurement update unit 110-2. Local pose propagation unit 110-1 implements the "predict" phase of the local Kalman filter. Specifically, local pose propagation unit 110-1 receives signals (local pose incremental information) from local rate sensing device 114. By utilizing these signals, local pose propagation unit 110-1 may propagate or "predict" certain states of corresponding perception sensor 102. For example, local pose propagation unit 110-1 may predict position, forward velocity, angular velocities, and angular orientation (attitude) of corresponding perception sensor 102. Local pose propagation unit 110-1 outputs a propagated local pose estimate of one or more of above states of the corresponding perception sensor 102 to local pose measurement update unit 110-2.

Local pose measurement update unit 110-2 may implement the measurement update (or "update") phase of the local Kalman filter. In the measurement update phase, an updated local pose estimate is determined for corresponding perception sensor 102 by updating the propagated local pose estimate using the primary pose information provided by primary positioning controller 108.

Thus, as described above, primary positioning controller 108 and local positioning controllers 110 form the "master-slave" configuration, with primary positioning controller 108 being the "master" and local positioning controllers 110 being the "slaves." Primary positioning controller 108 provides unified updating information (the primary pose information) to update pose estimates of all local positioning controllers 110. That is, the pose estimate update process in all local positioning controllers 110 is "controlled" by the same source, and thus the difference among local pose estimates of different local positioning controllers 110 can be reduced.

According to the present disclosure, when state update information from state update sources 116 is available to positioning system 106, for example, when GNSS signals are available to positioning system 106 using GNSS receivers as state update sources 116, the propagated primary pose estimate output by primary pose propagation unit 108-1 can be updated using the state update information from the state update sources 116, and therefore primary pose measurement update unit 108-2 can output a relatively accurate updated primary pose estimate. When state update information from state update sources 116 is not available to positioning system 106, the updated primary pose estimate generated by primary pose measurement update unit 108-2 may be based on old state update information form state update sources 116, and thus may have a relatively low accuracy, i.e., a relatively large error. However, such an error is passed to each of local positioning controllers 110. That is, all local positioning controllers 110 have the same error in the update phase. As a result, although local positioning controllers 110 may drift over time, they drift in a same direction, and thus the discrepancy among different local positioning controllers 110 is still small even in the situation where state update information from state update sources 116 is not available.

In some embodiments, primary rate sensing device 112 and local rate sensing devices 114 are identical to each other. In some embodiments, primary rate sensing device 112 may have a relatively higher quality than local rate sensing devices 114. For example, primary rate sensing device 112 has smaller drift over time than local rate sensing devices 114, and thus can provide better, more accurate, and/or more stable measurement results than local rate sensing devices 114. Therefore, with the "master-slave" configuration, positioning system 106 can achieve a relatively good perception result using only one high quality primary rate sensing device 112 and several relatively low quality local rate sensing devices 114, or using primary rate sensing device 112 and local rate sensing devices 114 that are both of relatively low quality. In contrast, for a positioning system without the "master slave" configuration, i.e., a positioning system having only local rate sensing devices and local positioning controllers coupled to perception sensors, to achieve a similar result, much higher quality and more stable local rate sensing devices are needed, in other words, positioning system 106 of the present disclosure can provide a good perception result with a relatively low cost.

Referring again to FIG. 1A, in some embodiments, positioning system 106 also includes one or more processors 118 and one or more storage medium 120. Processors 118 may be configured to perform various operations consistent with embodiments of the present disclosure. The term "processor" may include any physical device having an electric circuit that performs a logic operation on input. For example, processor 118 may include one or more integrated circuits, microchips, microcontrollers, microprocessors, all or part of a central processing unit (CPU), graphics processing unit (GPU), digital signal processor (DSP), field programmable gate array (FPGA), or other circuits suitable for executing instructions or performing logic operations.

Storage medium 120 may be a non-transitory computer-readable storage medium, such as a memory device (e.g., random access, flash memory, or the like), an optical medium (e.g., a CD, DVD, BluRay®, or the like), firmware (e.g., an EPROM), or any other storage medium. Storage medium 120 may store data captured by, for example, perception sensors 102. Storage medium 120 may also store a computer program containing instructions for execution by processor 118 to cause positioning system 106 to perform particular operations, such as operations consistent with embodiments of the present disclosure.

In some embodiments, instead of or in addition to storage medium storing the above-described computer program, positioning system 106 may also include hardware modules comprised of connected logic units, such as gates and flip-flops, and/or comprised of programmable units, such as programmable gate arrays or processors, for example, each of which is configured to perform part or all of the operations consistent with embodiments of the present disclosure.

Figure 3:
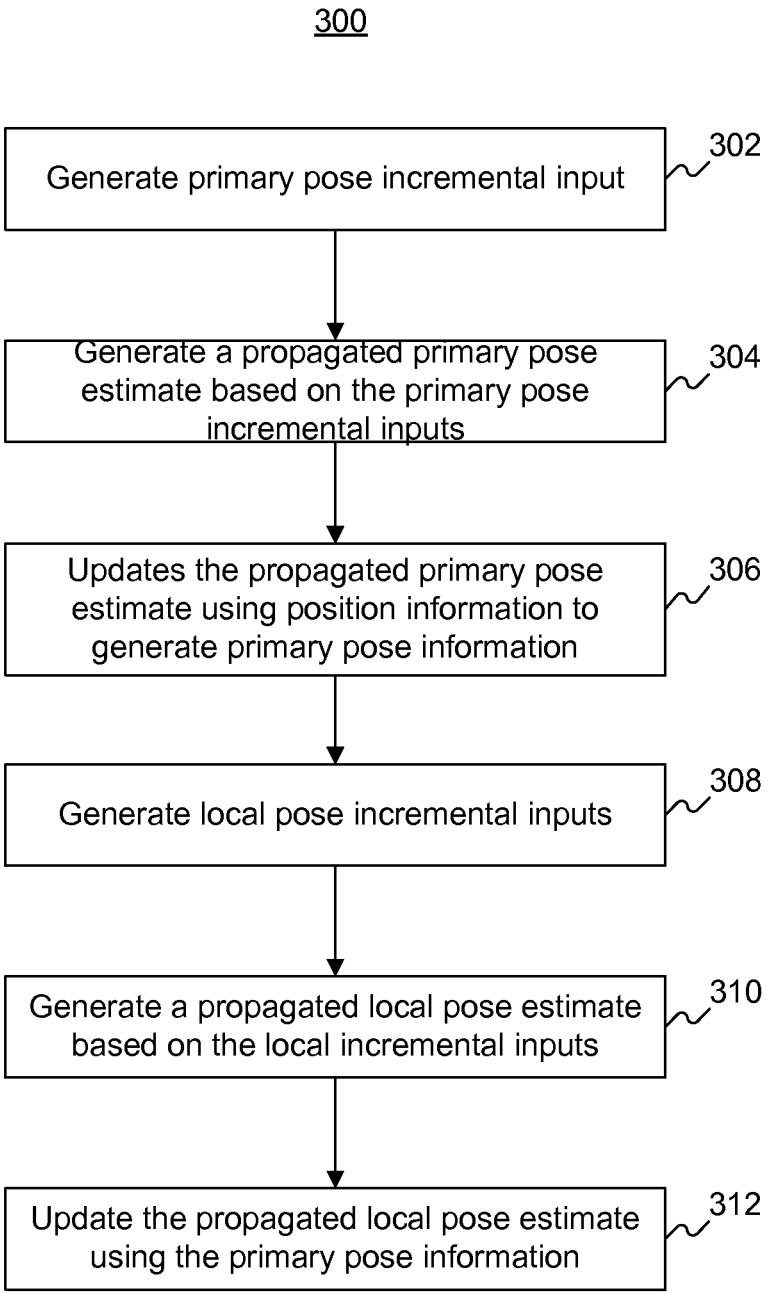
FIG. 3 is a flowchart showing an exemplary method that may be implemented by the system of FIG. 1.

FIG. 3 is a flow chart illustrating an exemplary method 300 for generating pose information. Method 300 may be executed by positioning system 106 consistent with embodiments of the present disclosure.

As shown in FIG. 3, at 302, primary rate sensing device 112 generates and sends primary pose incremental information to primary positioning controller 108. The primary pose incremental information may include angular rates and/or acceleration of machine 104.

At 304, primary positioning controller 108 generates a propagated primary pose estimate based on the primary pose incremental information. In some embodiments, other machine wide measurement inputs reflecting additional machine-wide state information of machine 104 may also be taken into consideration while generating the propagated primary pose estimate.

At 306, primary positioning controller 108 updates the propagated primary pose estimate using state update information provided by one or more state update sources 116 to generate an updated primary pose estimate and sends the updated primary pose estimate as primary pose information to local positioning controllers 110. In some embodiments, when state update information from state update sources 116 is not available, primary positioning controller 108 may update the propagated primary pose estimate using previously received state update information.

At 308, each local rate sensing device 114 generates and sends local pose incremental information to corresponding local positioning controller 110. The local pose incremental information may include angular rates and/or acceleration of corresponding perception sensor 102.

At 310, each local positioning controller 110 generates a propagated local pose estimate based on the local pose incremental information.

At 312, each local positioning controller 110 updates the corresponding propagated local pose estimate using the primary pose information to generate an updated local pose estimate and sends the updated local pose estimate to corresponding perception sensor 102.

Although FIG. 3 shows the above processes in a particular order, one skilled in the art will appreciate that this does not constitute a requirement that the processes consistent with the present disclosure are performed in such an order. For example, generating the local pose incremental information by local rate sensing device 114 (308 in FIG. 3) can be performed before or after updating the propagated primary estimate by primary positioning controller 108 (306 in FIG. 3).

INDUSTRIAL APPLICABILITY

In the embodiments described above, the disclosed positioning system is described in connection with a perception system. However, the disclosed positioning system may also be applicable to any machine that includes a system that is sensitive to consistency among different units of the system and localized disturbances. The disclosed positioning system may provide a more robust solution and better long-term consistency. For example, with the disclosed positioning system, a perception system may enhance operator awareness by reducing mismatching of images generated by different perception sensors in the perception system. In particular, the disclosed positioning system may reduce or eliminate the mismatching by creating a root-mean-square best machine level pose and use this machine level pose to update local pose of each perception sensor. As such, random drifting of the perception sensors is reduced and a higher long term relative accuracy can be obtained.

It will be apparent to those skilled in the art that various modifications and variations can be made to the disclosed imaging system. Other embodiments will be apparent to those skilled in the art from consideration of the specification and practice of the disclosed imaging system. It is intended that the specification and examples be considered as exemplary only, with a true scope being indicated by the following claims and their equivalents.

What is claimed is:

1. A positioning system for generating pose information of a machine, the positioning system comprising:

a primary positioning controller configured to generate primary pose information of the machine, the primary pose information reflecting an overall pose of an entirety of the machine;

a plurality of local positioning controllers associated with different portions of the machine and coupled to the primary positioning controller, each of the local positioning controllers being configured to:

generate local pose information for a different portion of the machine corresponding to the local positioning controller, the local pose information reflecting a local pose of the different portion of the machine corresponding to the local positioning controller, and update the local pose information based on the primary pose information; and a plurality of sensors configured to obtain images of surrounding of the machine, wherein the images of the surroundings of the machine are stitched, based on the updated local pose information of each local positioning controllers of the plurality of local positioning controllers, to form a surround view image of the surroundings of the machine.

2. The positioning system of claim 1, further comprising:

a primary rate sensing device coupled to the primary positioning controller and configured to provide primary pose incremental information to the primary positioning controller; and a plurality of local rate sensing devices, each of the local rate sensing devices being coupled to one of the local positioning controllers and configured to provide local pose incremental information to the corresponding local positioning controller.

3. The positioning system of claim 2, wherein the primary positioning controller includes:

a primary pose propagation unit configured to receive the primary pose incremental information from the primary rate sensing device and generate a propagated primary pose estimate based on the primary pose incremental information, the propagated primary pose estimate including an estimate of at least one state of the machine; and a primary pose measurement update unit coupled to the primary pose propagation unit and configured to update the propagated primary pose estimate to generate the primary pose information.

4. The positioning system of claim 3, further comprising:

at least one state update source coupled to the primary positioning controller, wherein the primary pose measurement update unit is configured to update the propagated primary pose estimate using state update information previously provided by the at least one state update source or state update information provided by the at least one state update source in real time.

5. The positioning system of claim 3, wherein the primary pose propagation unit is further configured to receive additional machine-wide state information and generate the propagated primary pose estimate based on the primary pose incremental information and the additional machine-wide state information.

6. The positioning system of claim 2, wherein each of the local positioning controllers includes:

a local pose propagation unit configured to receive the local pose incremental information from the corresponding local rate sensing device and generate a propagated local pose estimate based on the local pose incremental information, the propagated local pose estimate including an estimate of at least one state of the corresponding portion of the machine; and a local pose measurement update unit configured to update the propagated local pose estimate based on the primary pose information to generate the local pose information.

7. The positioning system of claim 2, wherein the primary rate sensing device and the local rate sensing devices are identical to each other.

8. The positioning system of claim 2, wherein the primary rate sensing device has a smaller drift over time than the local rate sensing devices.

9. The positioning system of claim 1, wherein the primary pose information includes at least one of a velocity or an orientation of the machine.

10. The positioning system of claim 1, wherein the updated local pose information includes at least one of a velocity or an orientation of the different portion of the machine.

11. A method for generating pose information of a machine, the method comprising:

generating primary pose information of the machine, the primary pose information reflecting an overall pose of an entirety of the machine;

generating local pose information, the local pose information reflecting a local pose of a portion of the machine;

updating the local pose information based on the primary pose information; and obtaining, using a plurality of sensors, images of surrounding of the machine, wherein the images of the surroundings of the machine are stitched, based on the updated local pose information of each local positioning controllers of the plurality of local positioning controllers, to form a surround view image of the surroundings of the machine.

12. The method of claim 11, wherein:

generating the primary pose information includes generating the primary pose information based on primary pose incremental information provided by a primary rate sensing device; and generating the local pose information includes generating the local pose information based on the primary pose information and local pose incremental information provided by one of a plurality of local rate sensing devices.

13. The method of claim 12, wherein generating the primary pose information includes:

generating a propagated primary pose estimate based on the primary pose incremental information; and updating the propagated primary pose estimate to generate the primary pose information.

14. The method of claim 13, wherein updating the propagated primary pose estimate includes updating the propagated primary pose estimate using state update information previously provided by at least one state update source or state update information provided by the at least one state update source in real time.

15. The method of claim 13, wherein generating the propagated primary pose estimate includes generating the propagated primary pose estimate based on the primary pose incremental information and additional machine-wide state information.

16. The method of claim 12, wherein generating the local pose information includes:

generating a propagated local pose estimate based on the local pose incremental information; and updating the propagated primary pose estimate based on the primary pose information to generate the local pose information.

17. The method of claim 12, wherein the primary pose incremental information has a drift over time similar to or smaller than a drift over time of the local pose incremental information.

18. The method of claim 11, wherein the portion of the machine includes a perception sensor, the method further including:

sending the local pose information to the perception sensor.

19. The method of claim 11, wherein:

generating the primary pose information includes generating at least one of a velocity or an orientation of the machine, and generating the local pose information includes generating at least one of a velocity or an orientation of the corresponding portion of the machine.

20. A perception system for providing a surround view of a machine, the perception system comprising:

a plurality of perception sensors configured to obtain images of surrounding of the machine; and a positioning system coupled to the perception sensors, the positioning system including:

a primary positioning controller configured to generate primary pose information of the machine, the primary pose information reflecting an overall pose of an entirety of the machine; and a plurality of local positioning controllers coupled to the primary positioning controller, each of the plurality of local positioning controllers being coupled to one of the perception sensors and being configured to:

generate local pose information based on the primary pose information, the local pose information reflecting a local pose of a different portion of the machine for a corresponding perception sensor of the plurality of perception sensors, wherein the images of the surroundings of the machine are stitched, based on the local pose information of each local positioning controllers of the plurality of local positioning controllers, to form a surround view image of the surroundings of the machine.

* * * * *